US006070424A

United States Patent [19]

Bauman et al.

[11] Patent Number: 6,070,424

[45] **Date of Patent: *Jun. 6, 2000**

[54] MODULAR REFRIGERATION UNIT

[75] Inventors: Jeffrey E. Bauman, Collingswood; Kennard C. Hildreth, III, Cedarville, both of N.J.; Johnie J. Cooper, Montgomery, Ala.; Michael J. Palladino, Hamilton; J. Thomas Jablonsky, Voorhees, both of N.J.

[73] Assignee: Victory Refrigeration Company, L.L.C., Cherry Hill, N.J.

[ * ] Notice: This patent is subject to a terminal disclaimer.

[21] Appl. No.: 09/261,711

[22] Filed: Mar. 3, 1999

Related U.S. Application Data

[63] Continuation-in-part of application No. 09/075,659, May 11, 1998, Pat. No. 5,953,929.

[51] Int. Cl.[7] ..... F25B 47/00

[52] U.S. Cl. ..... 62/279; 62/298; 62/285

[58] Field of Search ..... 62/298, 285, 279

[56] References Cited

U.S. PATENT DOCUMENTS

| | | | |
|---|---|---|---|
| 5,417,079 | 5/1995 | Rudick et al. | 62/253 |
| 5,664,430 | 9/1997 | Karman | 62/285 |
| 5,678,421 | 10/1997 | Maynard et al. | 62/407 |
| 5,697,227 | 12/1997 | Bruce et al. | 62/298 |
| 5,732,565 | 3/1998 | Ramakrishnan et al. | 62/298 |
| 5,953,929 | 9/1999 | Bauman et al. | 62/259.1 |

*Primary Examiner*—Henry Bennett
*Assistant Examiner*—Mark Shulman
*Attorney, Agent, or Firm*—Coats & Bennett, P.L.L.C.

[57] ABSTRACT

A refrigeration system includes a base having an inlet opening, an outlet opening, an evaporator pan, a condenser pan, and a compressor mounting surface all integrally formed therein. All of the components of the refrigeration system mount onto the base to from a unitary structure. An evaporator is mounted to the base above said evaporator pan. A condenser is mounted to said base above said condenser pan. A compressor mounted to the compressor mounting surface and operatively connected to said evaporator and said condenser. A cover encloses the inlet opening, outlet opening and evaporator.

15 Claims, 10 Drawing Sheets

MODULAR REFRIGERATION UNIT

RELATED APPLICATION

This application is a continuation in part of U.S. Ser. No. 09/075,659 filed May 11, 1998, now U.S. Pat. No. 5,953, 929.

FIELD OF THE INVENTION

The present invention relates generally to refrigeration equipment, and more particularly, to a modular refrigeration unit for refrigerators and freezers.

BACKGROUND OF THE INVENTION

The basic design of a refrigeration system has changed very little since its invention. A refrigeration system includes a compressor, condenser and evaporator. The compressor pumps a refrigerant gas through the condenser where the refrigerant gas liquefies and loses heat. The cooled, liquid refrigerant is then circulated through the evaporator where it absorbs heat from the surrounding air and vaporizes. The refrigerant gas returns back to the compressor where the process is repeated.

In the conventional design of reach-in refrigerators, it is customary to mount the components of the refrigeration system to the refrigerator cabinet. Typically, the components are mounted individually rather than as a unit. For example, the evaporator, compressor and condenser may all have their own brackets that secure those components to the cabinet of the refrigerator. Thus, the refrigeration system components are installed and removed one at a time.

The prior art method of mounting refrigeration system components individually has numerous drawbacks. First, a manufacturer may make many different styles and models of refrigerators. Each different model utilizes an assortment of components that are unique for that particular model. This requires a relatively large number of parts to be maintained in inventory.

Another disadvantage is that assembly of the refrigeration system components can be cumbersome. The components are usually mounted on a small space either on top of or within the cabinet. Assembling the refrigeration system components in such a small space can be difficult and time consuming.

Yet another disadvantage in prior art refrigerator designs is that it requires companies to maintain a relatively large inventory of finished product. Companies typically maintain an inventory for each individual style or model of refrigerator which is offered for sale. Because refrigerators and freezers are large goods, this requires that a substantial amount of space be devoted to inventory. Not only does the manufacturer have capital invested in the inventory, but the space needed to store the inventory significantly increases the cost of the goods.

Another disadvantage of prior art designs is that they are sometimes difficult to service. In many cases, components are installed in places that are difficult to reach by service personnel. This makes the service personnel's job more difficult. Further, poor design increases the cost of servicing the refrigeration equipment since the service personnel generally need more time to make needed repairs.

SUMMARY OF THE INVENTION

The present invention is a modular refrigeration unit which addresses the short-comings of prior art refrigeration systems discussed above. The refrigeration unit includes a molded, plastic base on which all of the refrigeration system components are mounted. The base includes an inlet opening, outlet opening, evaporator pan, condenser pan and compressor mounting surface that are all integrally formed in the base. An evaporator mounts to the base above the evaporator pan. A condenser mounts to the base above the condenser pan. A compressor mounts on top of the compressor mounting surface. A fan is mounted in either the inlet opening or outlet opening for drawing air into the inlet opening, through the evaporator, and out the outlet opening. A cover encloses the inlet opening, outlet opening and evaporator.

The base and cover include a locking mechanism for securing the cover to the base. In the preferred embodiment, the cover includes detents formed along the lower edge of the walls of the cover. The detents engage matching recesses formed in the base. The walls of the cover and base yield enough to allow the engagement and disengagement of the integrally formed detents with the recesses in the base.

Many of the components are designed to mount to the base without fasteners. In the preferred embodiment, the air circulating fans are mounted to panels that fit into either the inlet opening or outlet opening. The walls of the inlet opening or outlet opening have tapered or graduated columns to firmly hold the fan panels in place. The evaporator includes flanges with mounting holes therein that fit over onto alignment pins projecting up from the base. The cover restrains the evaporator from vertical movement so that the evaporator is prevented from lifting up off of the alignment pins.

In another aspect of the present invention, a spillway is formed in the base extending from the evaporator pan to the condenser pan. The spillway passes underneath the lower edge of the cover. A water trap is formed in the condenser pan adjacent to the spillway. The lower edge of the cover extends below the level of fluid in the water trap to prevent the entry of warm air into the space beneath the cover. Also, positive pressure on the outlet side of the evaporator helps prevent entry of ambient air into the cover.

The refrigeration unit of the present invention can be assembled separately from the cabinet of the refrigerator or freezer. The base and cover are intended to be standard components for many different models of refrigerators and freezers. Thus, the refrigeration unit can be used on many different refrigerators and freezers. This greatly simplifies manufacturing and reduces the number of parts that must be maintained in inventory.

The present invention also enables a reduction in inventory of finished product. An inventory of refrigeration units can be maintained separately from an inventory of cabinets. When an order is placed by a customer for a particular model, the appropriate refrigeration unit can be installed onto the appropriate cabinet at the time of shipment.

The refrigeration unit of the present invention is also designed to be easily serviced. The ease of manufacture is facilitated by the location of components and the elimination of fasteners.

Other objects and advantages of the present invention will become apparent and obvious from a study of the following description and the accompanying drawings that are merely illustrative of such invention.

DETAILED DESCRIPTION OF THE INVENTION

Figure 1:
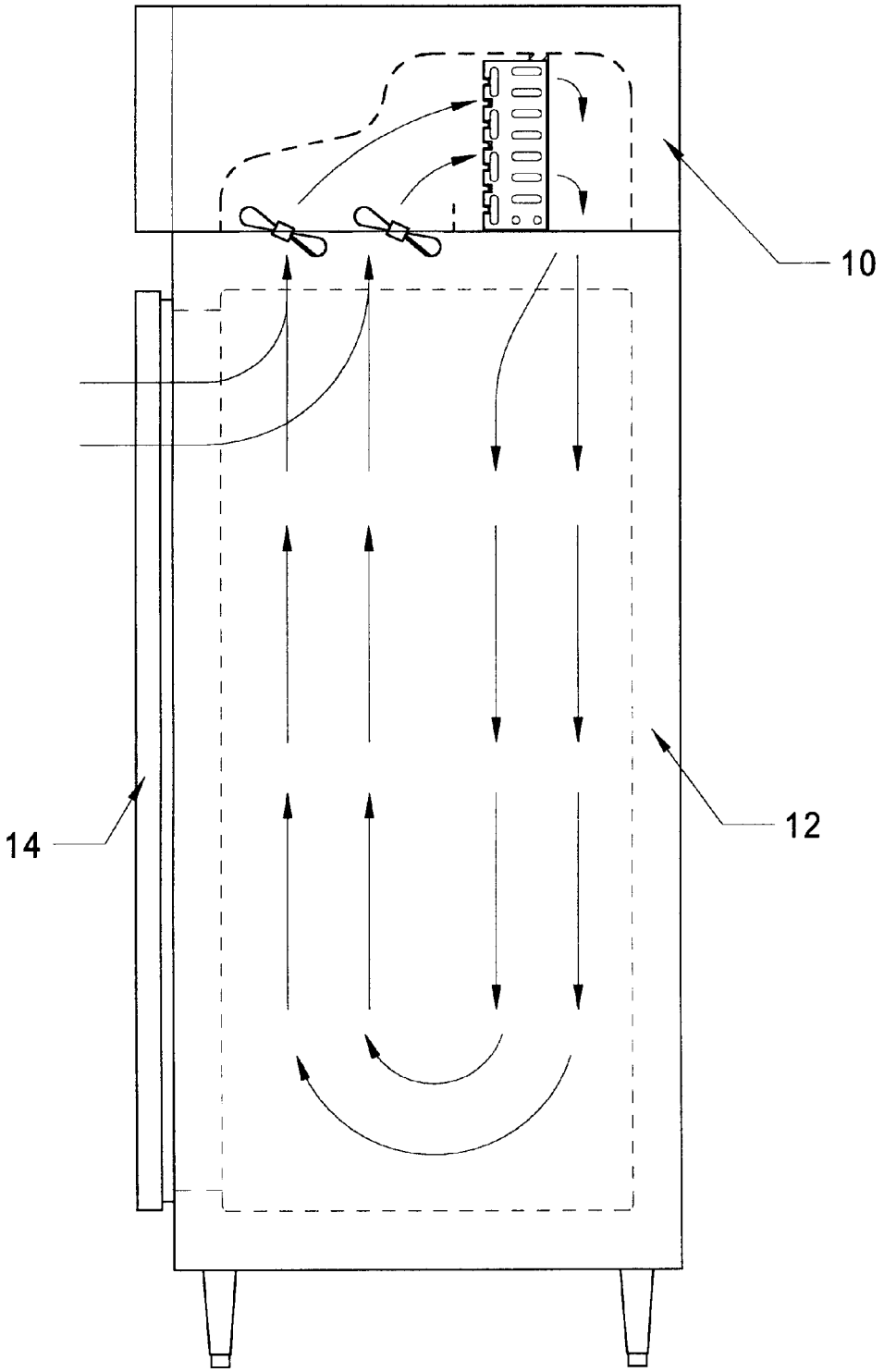
FIG. 1 is a side elevation view of a refrigerator incorporating the refrigeration unit of the present invention.
Figure 2:
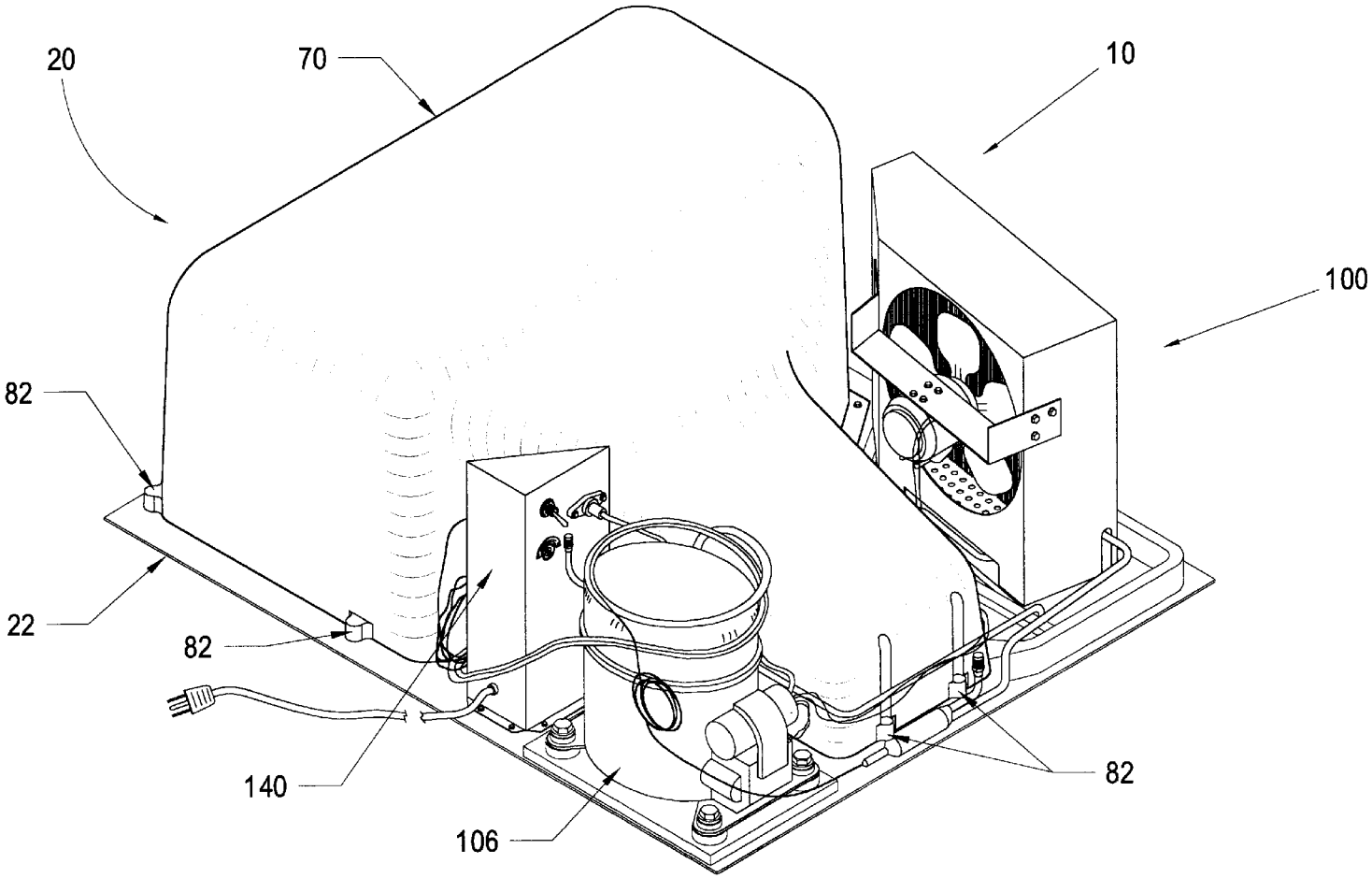
FIG. 2 is a perspective view of the refrigeration unit.
Figure 3:
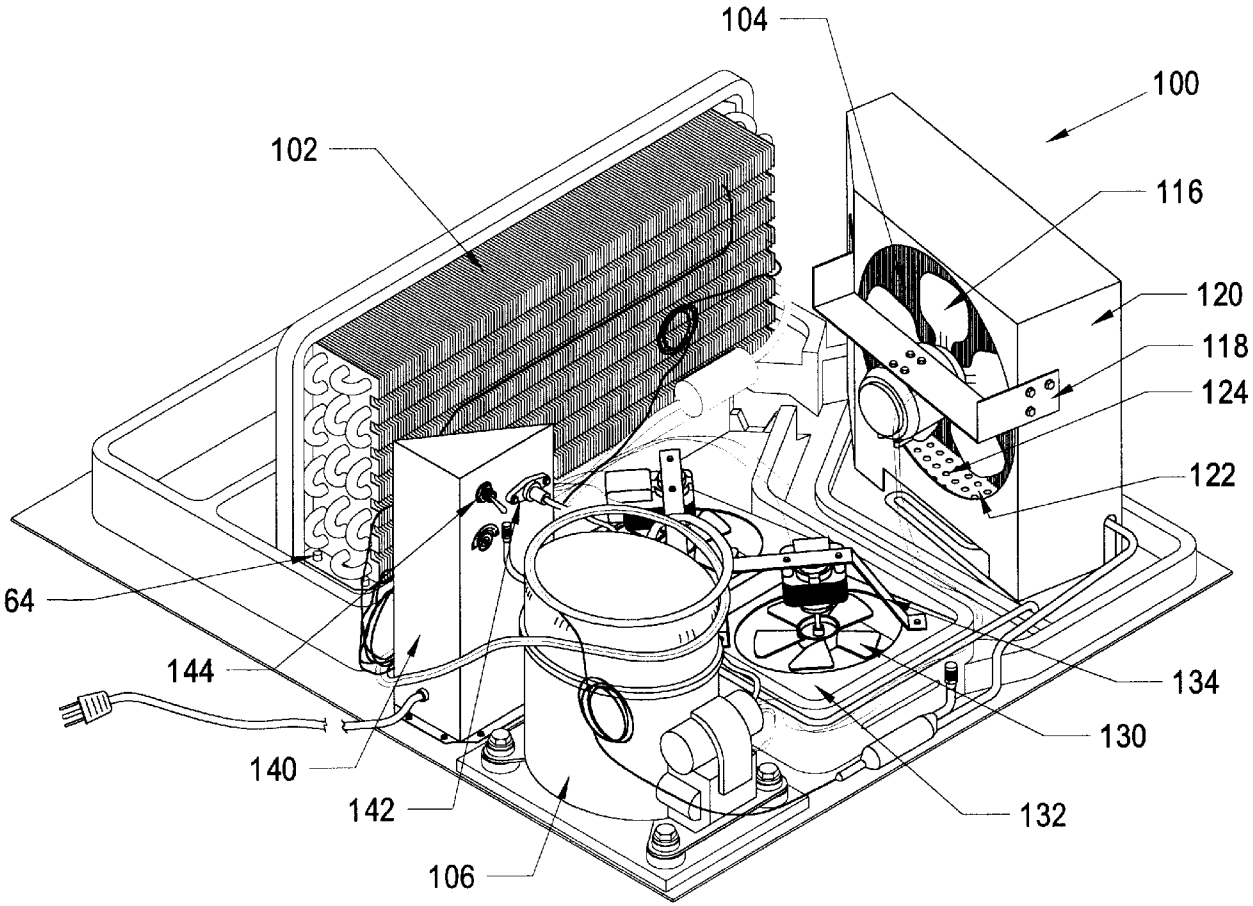
FIG. 3 is a perspective view of the refrigeration unit with the cover removed.

Referring now to the drawings, the refrigeration unit of the present invention is shown therein as indicated generally by the numeral 10. The refrigeration unit 10 mounts on top of a refrigerator/freezer cabinet 12. In the disclosed embodiment, the cabinet 12 is an upright cabinet having a door 14 in the front to provide access to the interior of the cabinet 12. As shown in the drawings, air is drawn upwardly through the cabinet 12 into the refrigeration unit 10, cooled by the refrigeration unit 10 and returned to the cabinet 12.

FIGS. 2 through 5 show the refrigeration unit 10 in more detail. The refrigeration unit 10 includes a housing 20 and a cooling system 100. The function of the housing 20 provides a unitary structure that supports all of the components of the cooling system 100. This allows the refrigeration units 10 to be pre-assembled separately from the cabinet 12.

The housing 20 includes a base 22 and a cover 70. Both the base 22 and cover 70 are formed from a thermoplastic material such as an ABS plastic. One example of a suitable material is LUSTRAN 752 made by Bayer Corporation. FIGS. 6 through 9, show the base 22 in more detail. The base 22 includes an inlet opening 24, an outlet opening 26, an evaporator pan 28, a condenser pan 30 and a compressor mounting surface 38 all integrally formed in the base 22. The inlet opening 24 is formed near the forward edge of the base 22. The inlet opening 24 has a generally rectangular configuration and extends from the forward edge of the base 22 towards the rearward edge. The outlet opening 26 is disposed adjacent to the rear edge of the base 22. The outlet opening 26 has an elongated rectangular configuration and extends parallel to the rear edge of the base 22. While the inlet opening 24 and outlet opening 26 are formed in the base 22 in the disclosed embodiment, those skilled in the art will recognize that the location of the openings is not a material aspect of the invention. The openings 24, 26 could, for example, be formed in the cover 70 of the housing 20. Alternatively, the openings 24, 26 could be formed by an open space between the base 22 and cover 70, such as when the cover 70 is sized larger than the base 22.

The evaporator pan 28 comprises an elevated surface 28 disposed between the inlet opening 24 and outlet opening 26. The evaporator pan 28 is generally rectangular in form and includes a mounting surface 62 for the evaporator 102 at each end thereof. The mounting surfaces 62 are elevated above the level of the evaporator pan 28. The mounting of the evaporator 102 will be described in greater detail below.

In the area to the right of the inlet opening 24 (as viewed from the front) there is formed a condenser pan 30. The condenser pan 30 is disposed at a level below the level of the evaporator pan 28. The condenser pan 30 has a trapezoidal shape. A weir or retaining wall 32 divides the area of the condenser pan 30 into two sections. The section of the condenser pan 30 adjacent to the evaporator pan 28 and inlet opening 24 shall be referred to herein as the water trap 34. The other section is referred to as the condensing pool. A drain channel or spillway 36 slopes downwardly from the evaporator pan 28 to the water trap 34. Condensate collecting in the evaporator pan 28 flows over the spillway 36 into the water trap 34. The function of the water trap 34 36 will be described in greater detail below.

Also, there is an inclined surface 37 adjacent the inlet opening 24. The inclined drip surface 37 slopes toward the spillway 36. The purpose of the inclined surface 37 is to direct any condensate that drips from the evaporator line back to the water trap 34.

On the left side of the inlet opening 24 there is formed a flat mounting surface 38 for the compressor. The compressor mounting surface 38 is elevated slightly above the bottom of the condenser pan 30 and is below the level of the evaporator pan 28. As the name implies, the compressor mounting surface 38 provides a mounting surface for the compressor 104.

The regions of the base 22 described above are defined by a wall structure indicated generally by the numeral 50. The wall structure 50 includes a rectangular wall 52 that surrounds the outlet opening 26 and evaporator pan 28. Rectangular wall 60 has an opening adjacent one corner for the spillway 36. A dividing wall 54 divides the area defined by the rectangular wall 52 into two regions and separates the evaporator pan 28 from the outlet opening 26. A generally u-shaped wall 56 substantially surrounds the inlet opening 24. The u-shaped wall 56 includes ends 58 that flare outwardly and extend generally toward the rectangular wall 60. There is a small gap 39 between the ends 58 of the U-shaped wall 56 and the rectangular wall 60. These gaps are to accommodate refrigerant lines extending to and from the evaporator 102 and electrical conductors for fans, heaters, etc. Wall 60 extends along the front and right sides of the condenser pan 30. Wall 60 is approximately half as high as walls 52, 54 and 56. The retaining wall 32, which divides the condenser pan 30, is approximately two-thirds the height the wall 60. Thus, when the water trap 34 is full, water will flow over the retaining wall 32 into the condensing pool.

In the preferred embodiment of the invention, the base 22 is made of two layers of sheet material, such as an ABS plastic. The top layer 23 is molded to create the evaporator pan 28, condenser pan 30, compressor mounting surface 38, inlet opening 24, outlet opening 26, and walls 56, 58, 60. The bottom layer 25 is preferably formed from a sheet material. The layers 23 and 25 are laminated together to form an insulating air space 27 between the layers 23 and 25, which may be filled with an insulating material such as foam. Alternatively, the top layer 23 and bottom layer 25 can be integrally formed during the molding process by blow molding the base 22.

Figure 4:
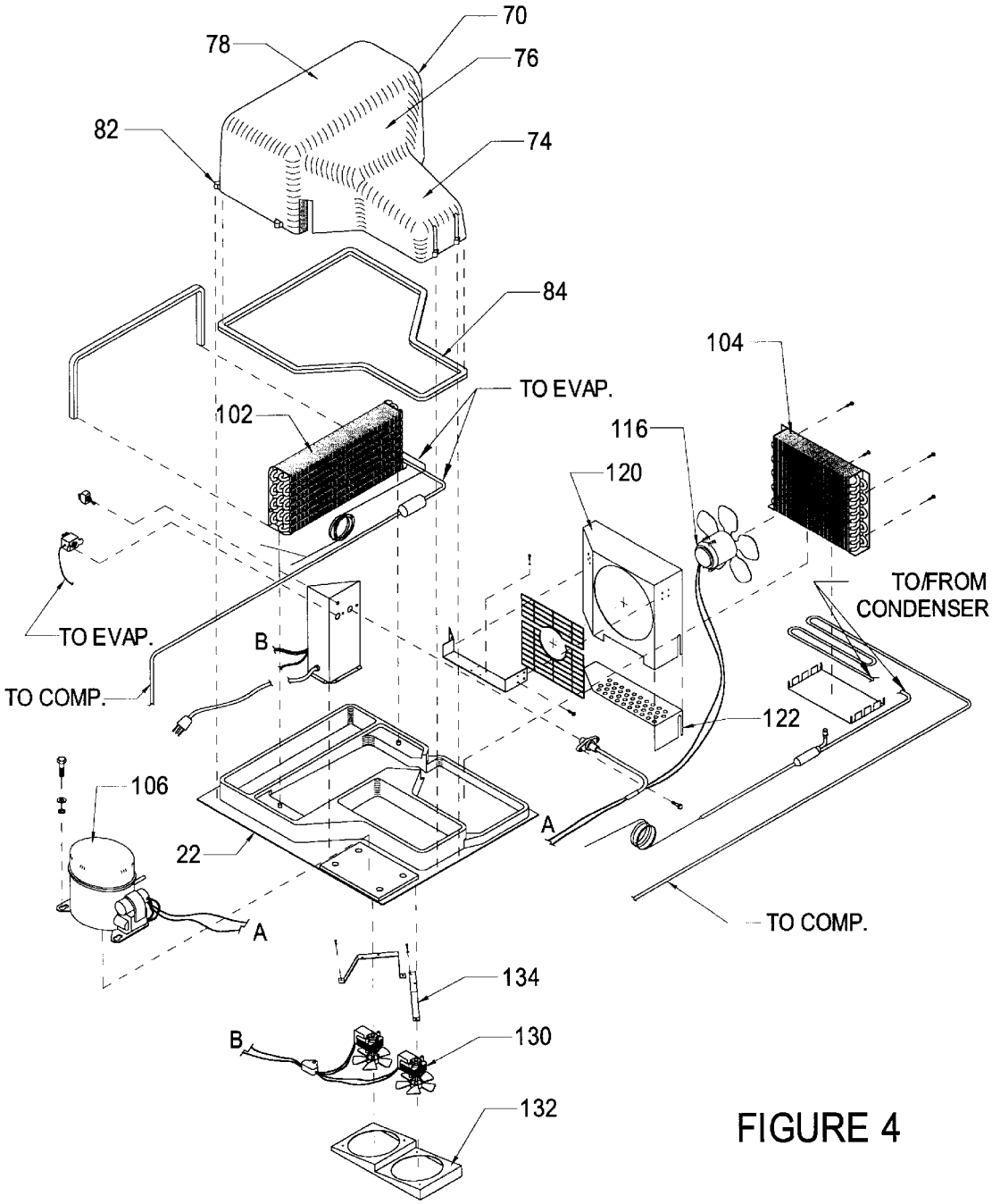
FIG. 4 is an exploded perspective view of the refrigeration unit.
Figure 5:
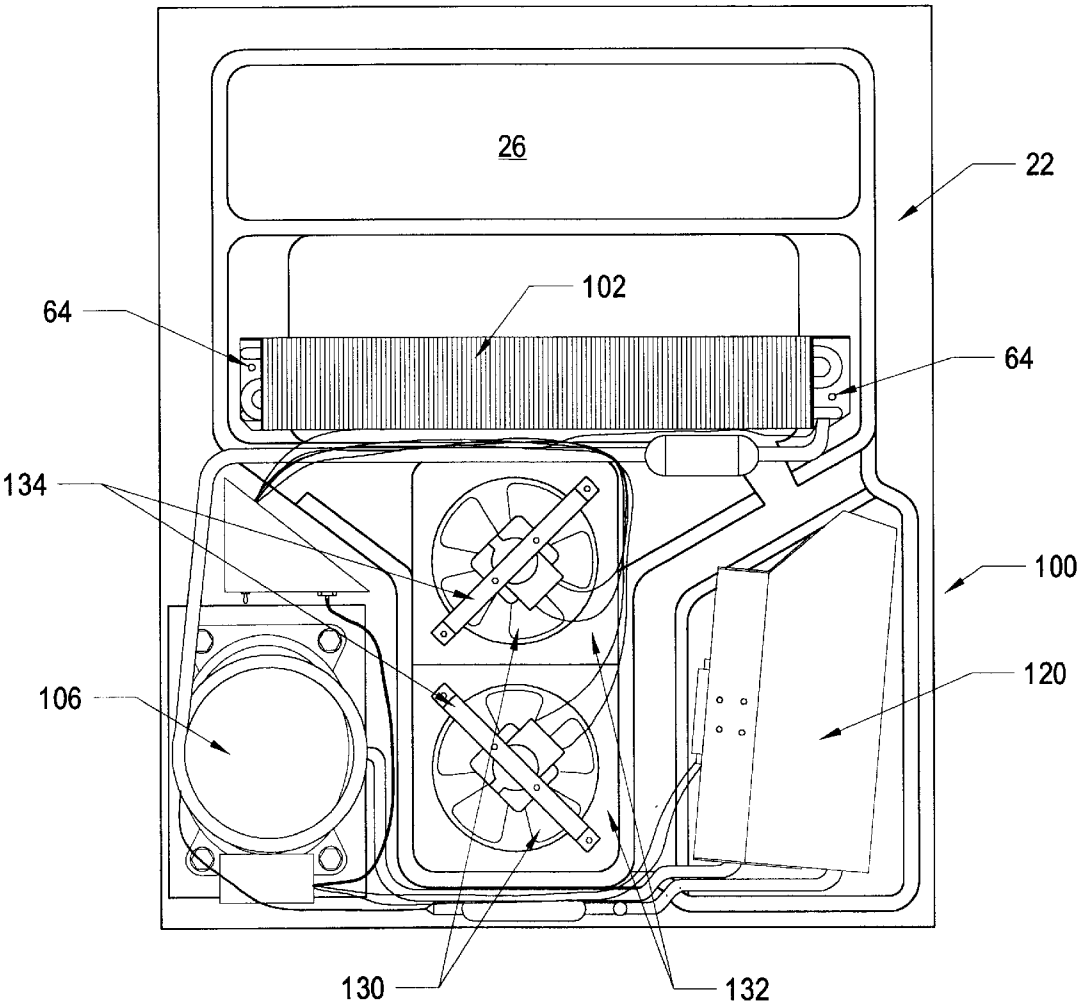
FIG. 5 is a plan view of the refrigeration unit with the cover removed.
Figure 6:
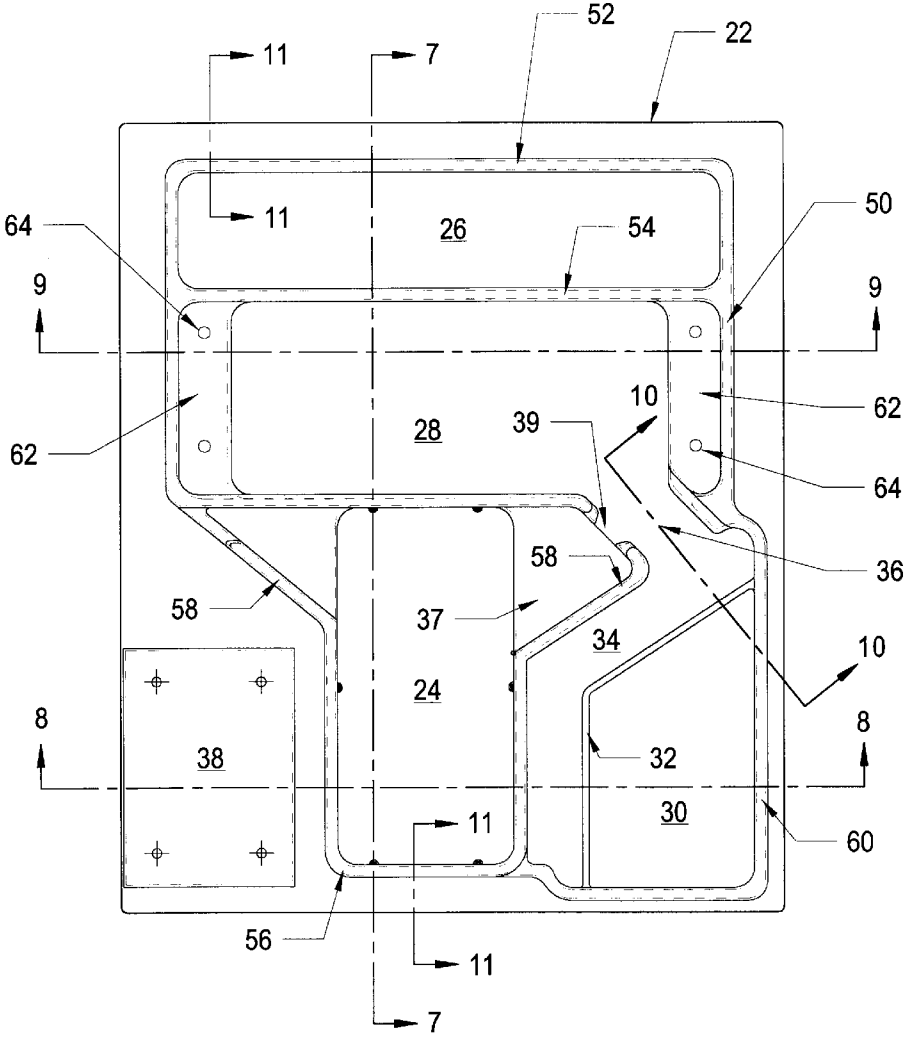
FIG. 6 is a plan view of the base of the refrigeration unit.
Figure 7:
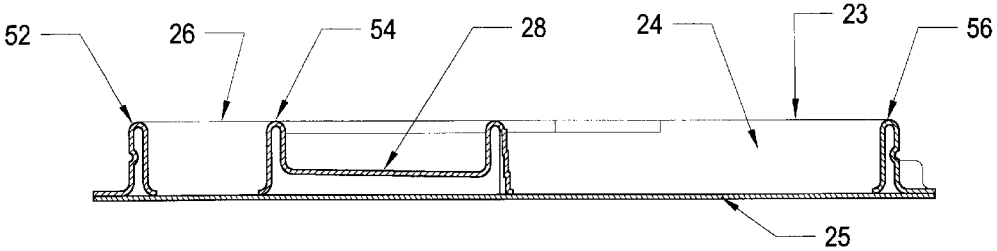
FIG. 7 is a longitudinal section view of the base taken along the center line.
Figure 11:
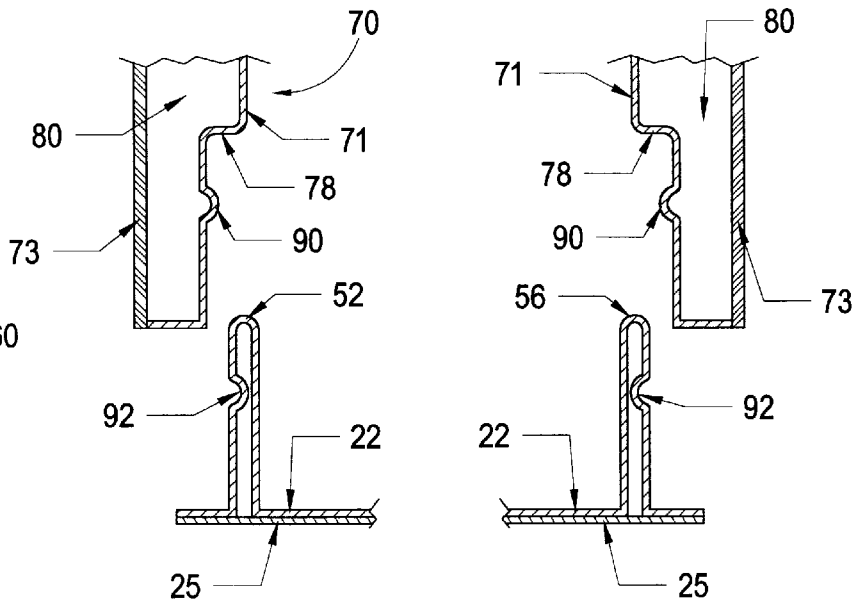
FIG. 11 is a partial section view showing the locking mechanism for securing the cover to the base.

The cover 70 is shown in FIGS. 4 & 11. The cover 70 includes an inner molded shell 71 and an outer molded shell 73 forming an air space 75 therebetween. The inner and outer shells 71, 73 can be molded independently of one another, or alternatively can be formed by blow molding the cover 70. The cover 70 includes a relatively large rear portion 72, a relatively small front portion 74 and an intermediate portion 76 connecting the rear portion 72 and front portion 74. A shoulder 78 is formed near the lower edge of the cover 70. The shoulder 78 extends around the entire cover 70. The shoulder 78 forms a seal 84 with the upper edge of walls 52 and 56 of the wall structure 50. A gasket or seal is preferably applied to the shoulder 78 so that an airtight seal is formed between the walls 52, 56 and cover 70. The cover 70 includes openings which align with the previously mentioned gaps in the wall structure 50 to facilitate the routing of refrigerant lines. An insulating material 80, such as foam, is blown into the air space 75 between the inner and outer shells 71, 73 to minimize heat loss and heat gain through the cover 70.

The base 22 and cover 70 include a locking mechanism for securing the cover 70 to the base 22. The locking mechanism comprises a series of detents 90 formed in the cover 70 that engage corresponding recesses 92 in the wall structure 50 of the base 22. In the disclosed embodiment, the cover 70 includes a single detent 90*a* located along the front edge of the cover 70 and a pair of detents 90 spaced along the rear edge of the cover 70. The wall structure 50 has matching recesses 92. One recess 92 is formed in wall 56 that surrounds the inlet opening 24. Additional recesses 92 are formed in the rectangular wall 52 that surrounds the evaporator pan 28 and outlet opening 26. The particular arrangement of the detents 90 and matching recesses 92 is not a material aspect of the invention. For example, the detents 90 could be placed on the wall structure 50 with the recesses 92 on the cover 70. Other fastening devices could also be used in addition to or in place of the detents 90 and recesses 92. For example, the embodiment shown in the Figures includes a series of hold-downs 82 integrally formed with the cover 70. The cover 70 and base 22 are held together in part by screws that pass through the hold-downs 82 and base 22 into the top of the refrigerator cabinet. Other fasteners, such as clips, buckles, and latches could also be used to secure the cover 70 to the base 22.

Figure 10:
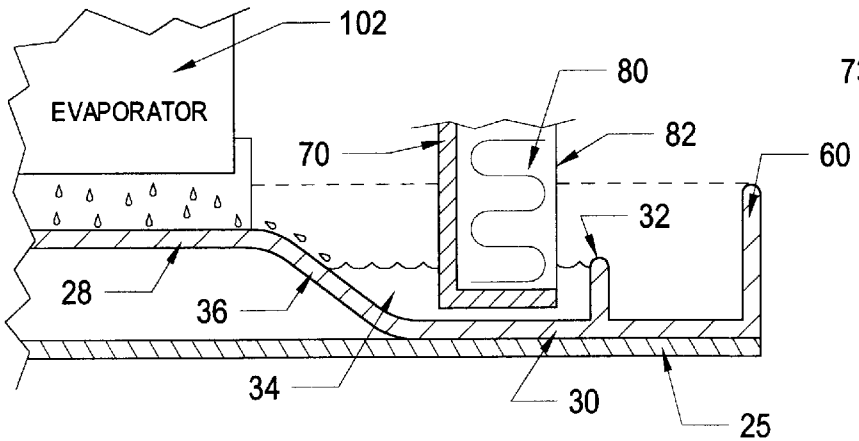
FIG. 10 is a partial section view of the base and cover showing the spillway and water trap.

As shown in FIG. 10, the lower edge of the cover 70 extends below the fluid level in the water trap 34 when the cover 70 is installed on the base 22. The spillway 36 passes underneath the lower edge of the cover 70 allowing fluid to drain from the evaporator pan 28 into the water trap 34. Because the level of fluid in the water trap 34 is above the lower edge of the cover 70, warm air is prevented from entering the space beneath the cover 70.

The cooling system 100 is shown best in FIGS. 2 through 5. The cooling system 100 includes an evaporator 102, condenser 104, and compressor 106, condenser fan 116 and air circulating fans 130.

The evaporator 102 is mounted to the base 22 above the evaporator pan 28. The ends of the evaporator 102 rest on the evaporator support surfaces 62 disposed at either end of the evaporator pan 28. The evaporator 102 includes a flange at each end thereof having a pair of holes formed therein. The holes in the evaporator flange align with molded alignment pins 64 projecting upwardly from the evaporator mounting surface 62. The alignment pins 64 serve to locate the evaporator relative to the evaporator pan. Other locating mechanisms could also be used. For example, the locating mechanism could comprise a recess in the evaporator support surface, an abutting surface in the evaporator pan, or any other structure that restrains the evaporator against lateral movement. When the cover 70 is installed onto the base 22, the cover 70 restrains the evaporator 102 from movement in the vertical direction. This prevents the evaporator 102 from lifting up off of the alignment pins 64. This design eliminates the need for separate fasteners to hold the evaporator 102 in place.

The condenser 106 is mounted above the condenser pan 30 and is enclosed within a housing 120. The condenser 106 is held in place by a bracket 126 that is captured between the base and the cover. Bracket 126 comprises a piece of bent metal that includes a hook shaped element at one end that engages the top edge of the wall structure 50. The opposite end is connected by a screw or other fastener to the condenser housing 120. The bracket is held in place by the cover 70 and no other fasteners are required.

The condenser fan 116 is mounted to the condenser housing 120 by a bracket 118. The condenser fan 116 is activated whenever the compressor 106 is activated to circulate air over the coils of the condenser 106. A baffle plate 122 is located at the bottom of the housing 120. The baffle plate 122 includes a series of perforations 124. Turbulent air in the housing 120 exits through the perforations 124 in the baffle plate 122 and impinges upon water in the condensing pool which is disposed below the condenser 106. It is believed that the turbulent air facilitates evaporation of the water in the condensing pool.

Figure 8:
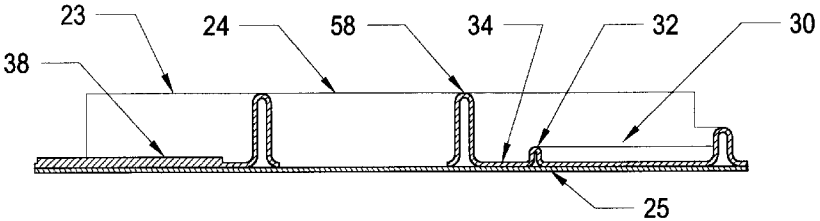
FIG. 8 is a transverse section view of the base taken through the inlet opening.
Figure 9:
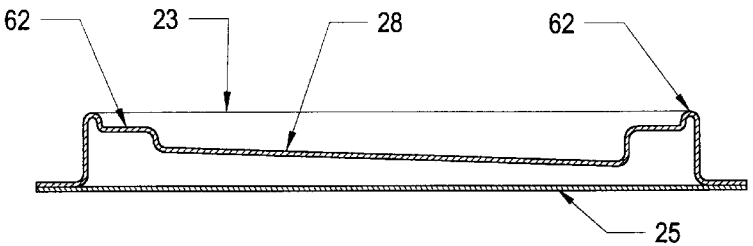
FIG. 9 is a transverse section view of the base taken through the evaporator pan.

The compressor 106 is mounted on top of the compressor mounting surface 38 of the base 22. As shown in FIG. 8, the compressor mounting surface 38 is slightly elevated. This results in a recess formed in the underside of the base 22 directly below the compressor mounting surface 38. A plate made of a hard plastic or metal is inserted into the recess below the compressor mounting surface 38. Four anchor holes are drilled through the compressor mounting surface 38 and plate to accommodate anchor bolts for securing the compressor 106. Three of the anchor holes have nut inserts pressed therein. The corresponding anchor bolts thread into the nut inserts. The fourth anchor hole (the one adjacent the corner of the base 12) receives a self-tapping screw. The screw passes through the compressor mounting surface 38, plate, and top of the cabinet 12. Thus, the fourth anchor screw helps to secure the refrigeration unit 10 to the cabinet 12.

Figure 13:
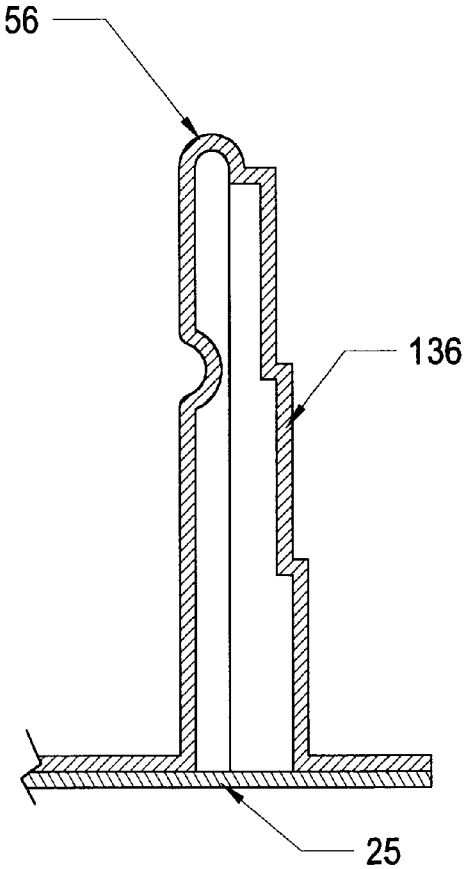
FIG. 13 is a detail of the wall surrounding the inlet opening showing the support ribs.
Figure 12:
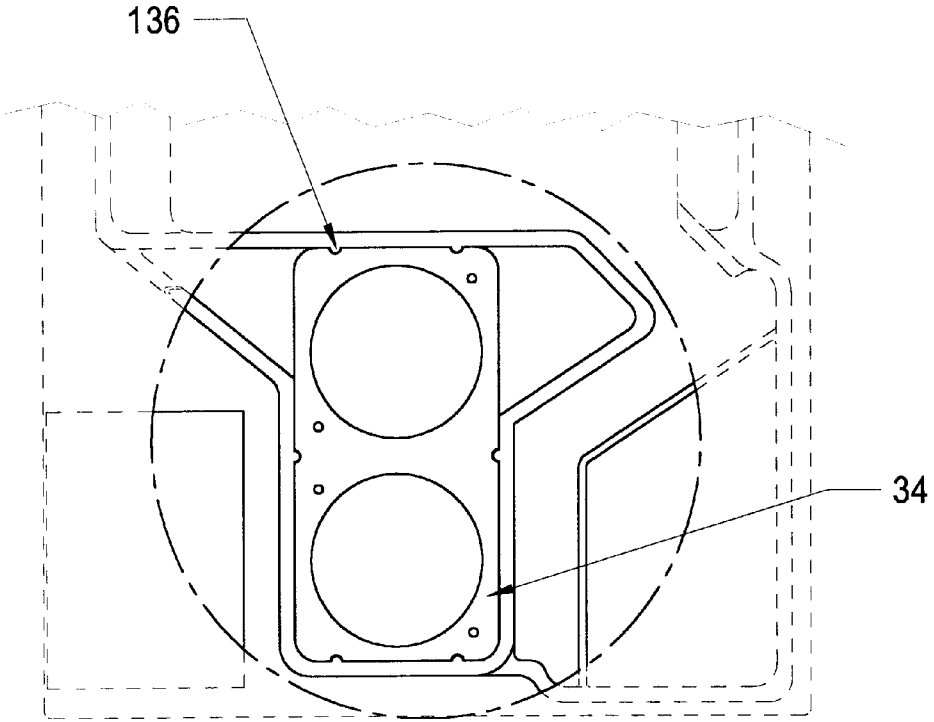
FIG. 12 is a detail showing the mounting of the fan panels in the inlet opening of the base.
Figure 15:
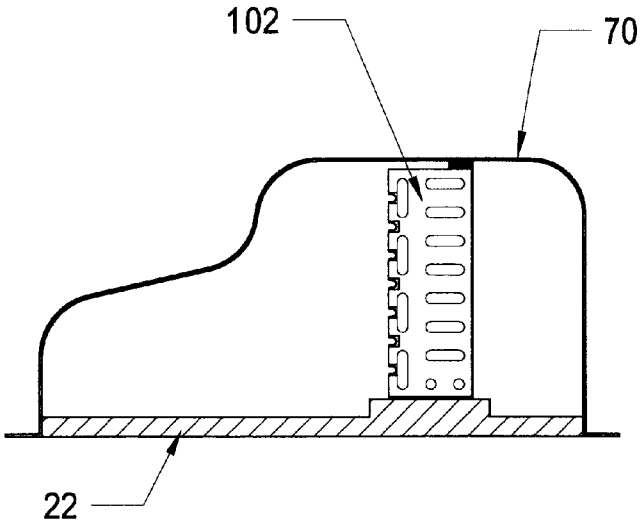
FIG. 15 is a schematic diagram showing the base, cover and evaporator.
Figure 14:
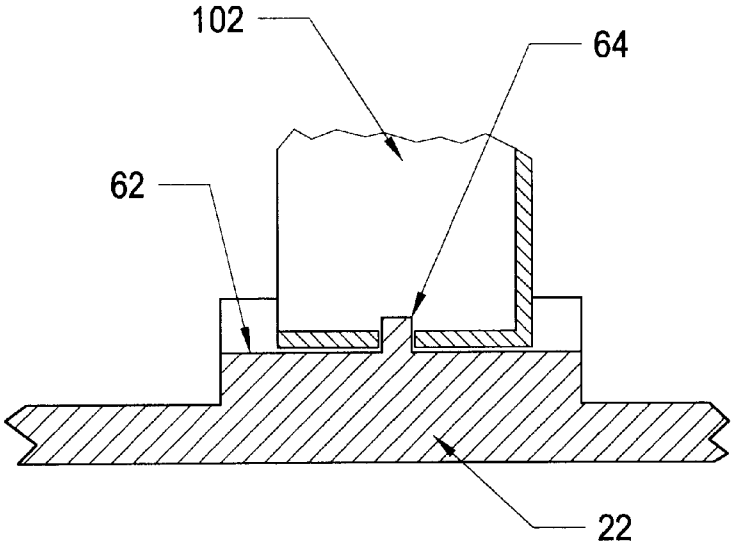
FIG. 14 is a detail showing the mounting of the evaporator.

A pair of air circulating fans 130 are mounted within the inlet opening 24 beneath the cover 70. Some systems, however, may require only a single fan. Each fan 130 is mounted by means of a bracket 134 to a fan panel 132. The fan panels 132 fit into the inlet opening 24. The walls surrounding the inlet opening 24 have integrally formed support ribs 136. In the disclosed embodiment, there are six support ribs 136, though the number and location of the support ribs 136 may vary. As seen in FIG. 13, the support ribs 136 include steps which increase in size from the top of the support rib 136. Alternatively, the support ribs 136 could be tapered. The fan panels 132 include notches 138 as shown in FIG. 12 that match up with the support ribs 136. The fan panels 132 are pressed downwardly into the inlet opening 24 over the support ribs 136. The taper of the support ribs 136 produces a wedging action that holds the fan panels 132 in place. When the fan panels 132 are fully inserted in the inlet opening 24, the force exerted by the support ribs 136 holds the fan panels 132 in place.

The cooling system 100 controls are contained within a housing 140 mounted to the base 22 adjacent to the compressor 106. The housing contains a thermostat 142 and a power switch 144. The thermostat 142 monitors the temperature of the air and activates the compressor 106 when the temperature of the air reaches a pre-determined set point. The condenser fan 116 is activated at the same time as the compressor 106. Typically, the compressor 106 continues running until the temperature of the air drops to a second pre-determined set point. The housing may include additional controls which are well known to those skilled in the art of refrigeration systems.

Refrigerant lines 108, 110 and 112 connect the evaporator 102, condenser 104 and compressor 106 and forms a closed circuit. Refrigerant line 108 extends from the compressor 106 to the evaporator 102. Refrigerant line 108 includes an expansion valve (not shown) that causes liquid refrigerant to expand and vaporize. Refrigerant line 110 extends from the evaporator 102 to the condenser 104. Refrigerant line 110 transports refrigerant gas to the condenser 106 where the refrigerant loses heat and returns to a liquid state. Refrigerant line 112 extends from the condenser 104 to the compressor 106.

The cooling system 100 operates in a conventional manner. The compressor 106 circulates liquid refrigerant through the evaporator 102 and condenser 104. In the evaporator 102, the refrigerant vaporizes drawing heat from the air surrounding the evaporator coils. Thus, the surrounding air is cooled. In the condenser, air cools the refrigerant causing the refrigerant to lose heat and liquefy. This process repeats each time the refrigerant circulates through the evaporator 102 and condenser 104.

In use, the evaporator 102, condenser 104, compressor 106 and air circulating fans 130 are mounted to the base 22 and operatively connected as described above. The cover 70 is then installed onto the base 22 by placing the cover 70 over the inlet opening 24, evaporator 102, and outlet opening 26. As the cover 70 is pressed down onto the base 22, the walls of the cover 70 yield enough to allow the detents on the interior surface of the cover 70 to engage with the recesses in the wall structure 50. The detents hold the cover 70 in place without the requirement of additional fasteners.

One of the advantages of the present invention is that the refrigeration unit 10 can be pre-assembled independently of the cabinet 12. Thus, assembly of the refrigeration unit 10 can be done either before, after or during assembly of the cabinet 12. Also, it will be apparent to those skilled in the art that the final assembly of the refrigeration unit 10 onto the cabinet 12 can be done at the time of shipment.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A refrigeration module comprising:

a. a molded housing including molded base and a cover;

b. a first insulating air space formed in said base;

c. an inlet opening and an outlet opening formed in said housing;

d. an evaporator pan integrally formed in said base;

e. an evaporator mounted in said housing above said evaporator pan;

f. a condenser pan integrally formed in said base;

g. a condenser mounted in said housing above said condenser pan;

h. a compressor mounted in said housing and operatively connected to said evaporator and said condenser; and i. an evaporator fan mounted in said housing for circulating air through said evaporator.

2. The refrigeration module according to claim 1 wherein said first air space is filled with an insulating material.

3. The refrigeration module according to claim 1 wherein said evaporator fan is mounted in said inlet opening.

4. The refrigeration module according to claim 1 wherein said evaporator fan is mounted in said outlet opening.

5. The refrigeration module according to claim 1 further including a spillway extending under the lower edge of said cover from said evaporator pan to said condenser pan to allow condensed water to flow from said evaporator pan to said condenser pan.

6. The refrigeration module according to claim 5 further including a weir in said condensing pan which forms a water trap on the side of said weir adjacent said spill way to prevent the flow of air from said condenser pan to said evaporator pan, and a condensing pool on the other side of said weir.

7. The refrigeration module according to claim 6 wherein said weir is lower than a top edge of said condensing pan to allow overflow from said water trap into said condensing pool.

8. The refrigeration module according to claim 1 wherein said cover includes an inner shell and an outer shell defining a second insulating air space between the inner and outer shells.

9. The refrigeration module according to claim 8 wherein said second air space is filled with an insulating material.

10. An enclosure for a refrigeration system comprising:

a. a housing including a base and a cover detachable from said base;

b. said base having an upper layer and a lower layer defining a first air space therebetween;

c. said cover having an inner shell and an outer shell defining a second air space therebetween;

d. an inlet opening and an outlet opening integrally formed in said housing;

e. an evaporator pan integrally formed in said base; and f. a condenser pan integrally formed in said base.

11. The enclosure according to claim 10 wherein said evaporator pan is elevated above said condenser pan.

12. The enclosure according to claim 11 further including a spillway extending from said evaporator pan to said condenser pan.

13. The enclosure according to claim 12 further including a water trap disposed adjacent said spillway to prevent the flow of air from said condenser pan to said evaporator pan.

14. The enclosure according to claim 10 wherein said first air space is filled with an insulating material.

15. The enclosure according to claim 10 wherein said second air space is filled with an insulating material.

* * * * *